US010458381B2

(12) United States Patent
McCormack

(10) Patent No.: US 10,458,381 B2
(45) Date of Patent: Oct. 29, 2019

(54) FUEL INJECTOR TESTER/CLEANER KIT AND METHOD OF USE

(71) Applicant: David J. McCormack, Upton, KY (US)

(72) Inventor: David J. McCormack, Upton, KY (US)

( * ) Notice: Subject to any disclaimer, the term of this patent is extended or adjusted under 35 U.S.C. 154(b) by 0 days.

(21) Appl. No.: 15/965,393

(22) Filed: Apr. 27, 2018

(65) Prior Publication Data

US 2018/0372050 A1 Dec. 27, 2018

Related U.S. Application Data

(60) Provisional application No. 62/490,801, filed on Apr. 27, 2017.

(51) Int. Cl.
*F02M 65/00* (2006.01)
*F02B 77/04* (2006.01)

(52) U.S. Cl.
CPC ..... *F02M 65/006* (2013.01); *F02M 65/008* (2013.01); *F02B 2077/045* (2013.01); *F02M 65/001* (2013.01)

(58) Field of Classification Search
CPC .... F02M 65/00; F02M 65/001; F02M 65/008; F02M 65/006; F02B 2077/045
See application file for complete search history.

(56) References Cited

U.S. PATENT DOCUMENTS

| | | | | |
|---|---|---|---|---|
| 4,082,565 | A | 4/1978 | Sjolander | |
| 4,520,773 | A * | 6/1985 | Koslow | F02B 77/04 123/198 A |
| 4,784,170 | A | 11/1988 | Romanelli | |
| 4,804,005 | A | 2/1989 | Hartopp | |
| 4,845,979 | A | 7/1989 | Farenden | |
| 5,000,043 | A | 3/1991 | Bunch, Jr. | |
| 5,090,377 | A | 2/1992 | Pearson | |
| 5,295,497 | A | 3/1994 | Skovron | |
| 5,633,457 | A | 5/1997 | Kilar | |
| 5,829,460 | A | 11/1998 | Acevedo | |
| 6,234,002 | B1 | 5/2001 | Sisney | |
| 6,281,020 | B1 | 8/2001 | Usui | |
| 6,530,392 | B2 | 3/2003 | Blatter | |
| 7,970,520 | B2 | 6/2011 | Gross | |
| 8,551,260 | B2 | 10/2013 | Horriat | |
| 8,926,763 | B2 | 1/2015 | Ogasawara | |
| 9,027,394 | B2 | 5/2015 | Kordass | |
| 9,097,226 | B2 | 8/2015 | Cueto | |

* cited by examiner

*Primary Examiner* — Hieu T Vo
(74) *Attorney, Agent, or Firm* — David W. Carrithers; Carrithers Law Office, PLLC

(57) ABSTRACT

A pneumatic and hydraulic testing and cleaning kit for gasoline type fuel injectors used in electronic fuel injection systems on most cars today. The tester/cleaner apparatus includes a stand with pneumatic quick disconnect for applying air and a solvent in pulses at 35 to 55 psi to clean dirty fuel injectors.

3 Claims, 5 Drawing Sheets

FUEL INJECTOR TESTER/CLEANER KIT AND METHOD OF USE

CROSS REFERENCES TO RELATED APPLICATIONS

This application claims priority from U.S. Provisional Application Ser. No. 62/490,801 filed on Apr. 27, 2017 and is hereby incorporated by reference in its entirety.

TECHNICAL FIELD

The present invention relates to the field of devices and kits for cleaning fuel injectors used on gasoline or diesel engines.

BACKGROUND OF THE INVENTION

Electronic fuel injection (EFI) is one of the most important breakthroughs for improving fuel consumption, pollution controls, increased power for smaller engines and for vehicles in the past fifty years. A much more precise fuel mixture is delivered into the cylinders than with even the most sophisticated carburetors over the entire engine speed range. Carburetors are set for the correct fuel mixture at one given engine speed but when the engine runs at a lower or higher speed, the mixture is no longer correct. With electronic fuel injection, the fuel is supplied to the injectors at a constant pressure and the injectors open and close at a controlled frequency and pulse width. This frequency and pulse width is controlled by an electronic controller. The electronic controller knows the speed at which the engine is running, as well as other pertinent factors, and can therefore change the frequency and pulse width sent to the coils of the fuel injectors to control the fuel mixture at the optimum amount for any given engine speed and situation.

Electronic fuel injection systems are very efficient and dependable, but suffer from one main problem. Fuel injectors should spray the fuel creating a mist of gasoline which then mixes evenly into air in the intake manifold or in the throttle body of a gasoline engine. Over time, the nozzles of the fuel injectors acquire a build-up of deposits at the output orifice. These deposits prevent a clean spray and cause a partial spray along with dripping of fuel. This dripping prevents the fuel from mixing with the air. The result is poor power, poor performance and increased fuel usage.

The deposits on fuel injectors come mainly from compounds and impurities in gasoline. Gasoline is composed of many different hydrocarbons, including olefins, which are heavy, waxy compounds. When the engine is shut off, a drip of gasoline often forms on the tip of the injector. Because the engine is hot, the volatiles in the drip of gas evaporate quickly, leaving olefin and other residue and because the engine is off, there is no cooling air flow through the ports and no fuel flow through the injectors to wash it away. Consequently, heat bakes the olefins into hard varnish deposits. Over time, these deposits can build up and clog the injectors or leave a crusty residue on or around the output orifice of the injectors. This buildup causes uneven spray or even dripping of fuel which will not evaporate into the gas-air mixture, thus causing poor performance.

Since the accumulation of these deposits is to be expected, detergents are added to gasoline to help keep the injectors clean. These detergents are typically successful in keeping the injectors clean. But lower quality gasolines contain less or weaker detergents which may allow more deposits to occur and grow. Also, when a driver makes a lot of short-trips, the deposits may can build up faster than the detergents can wash them away.

Commonly used deposit-control additives include polysibutylamine, polyisbutylene succinimide and polyisobutylene phenylamine. But these same additives can cause other issues such as a build up on intake valve stems which may cause them to stick. To prevent this, additional additives called "fluidizers" can also be added to the fuel. But, these can in turn, cause the formation of combustion chamber deposits that raise compression and the engine's octane requirements.

One of the best additives is polyetheramine, which keeps injectors, valves and combustion chambers clean without the help of any additional fluidizers. However polyetheramine is twice as expensive as the fluidizers. Experts recommend that about 1,000 parts per million (ppm) in the fuel is required to do a good job. This concentrations costs the gasoline supplier less than a penny a gallon. But, as might be expected, it is estimated that 85% of the gasoline being sold contains only one-tenth of the recommended dosage, or only 100 ppm of additive. Consequently, using cheap gas contributes to the formation of injector deposits.

Aside from these deposits, the fuel injectors can get clogged up by debris and impurities. Although gas and diesel tanks at service station use filters, anytime a tanker truck transfer fuel into a storage tank the tank is stirred and any sediment or water normally lying in the bottom of the tank below the suction line to be distributed within the fuel. Debris from the tank can then be pumped into the fuel tank of a vehicle. Fuel filters catch the majority of impurities but a small amount may make it past the filter. If there is water in the fuel system, corrosion can happen within the lines and fittings of the fuel system. This corrosion can cause debris to be jammed in the injectors.

Therefore, it is apparent that while electronic fuel injection is superior to older gasoline delivery systems in internal combustion engines, there will continue to be inherent problems with such systems.

Most systems today utilize a solvent applied to the fuel tank of a vehicle of a cleaner system applied to the fuel line of a vehicle to enable the vehicle to run and pump the fuel through the filter system.

The instant invention is a pneumatic and hydraulic using alternating air and liquid pulsed cycles for cleaning and reconditioning expensive fuel injectors removed from vehicles at scrap yards and reused where vehicles may set for an extended period of time and lack of use of the injectors allows the deposits to dry or harden during nonuse. Conventional fuel cleaners can not be circulated through the fuel system in vehicles which no longer run requiring that the injectors be removed to clean or recondition them prior to reuse. The hardened deposits are stubborn to remove and conventional systems fail to provide the requisite performance required from the injector.

DESCRIPTION OF THE RELATED ART

U.S. Pat. No. 6,234,002 for APPARATUS AND METHODS FOR CLEANING AND TESTING FUEL INJECTORS by Sisney et al which issued on May 22, 2001, teaches a kit including a cleaning fluid container, an electrical pump, and tubing and fittings for connecting a fuel injector for cleaning U.S. Pat. No. 4,784,170 for FUEL INJECTOR CLEANER KIT by Romanelli et al which issued on Nov. 15, 1988 teaches a fuel injector cleaning kit including a container containing a pressurized mixture of a fuel injector cleaning fluid and a motor vehicle fuel. The kit includes instructions, hoses and adapters for connection to a plurality of different motor vehicles. An adjustable pressure regulator, included as part of the kit, controls the pressure of the mixture delivered to the vehicle to a value specific to the particular vehicle.

SUMMARY OF THE INVENTION

In accordance with the present invention, there is provided a fuel injector cleaning kit comprising, consisting of, or consisting essentially of an ultrasonic cleaner, a fuel injector cleaning and test stand, and a fuel injector controller. The ultrasonic cleaner includes a container for holding cleaning fluid and a fuel injector, an ultrasonic transducer capable of vibrating the container and the cleaning fluid at a selected ultrasonic frequency and amplitude, and a controller for controlling the transducer. The fuel injector cleaning and test stand includes a horizontal base plate including an upward extending first longitudinal member forming a post. The base plate supports a removable waste container for catching cleaning fluid emitted from a fuel injector during testing. The post has a second longitudinal member forming an arm extending horizontally out from a top end thereof over the base plate. The arm has a vertical aperture formed therein and passing through at a free end thereof. The vertical aperture has threads in a top half and has a smooth inner bore in the bottom half. The smooth inner bore forms a receiver for an input end of a fuel injector with a first hand valve threaded into the threaded top half of the vertical aperture. The bottom of the vertical aperture is capable of receiving an input end of a fuel injector to be cleaned along with a sealing O-ring. The arm has a retaining plate rotatably connected to a bottom surface thereof such that when the input end of the fuel injector is inserted into the receiver, the retaining plate is rotated in under an output end of the fuel injector to hold the fuel injector tightly in place. The retaining plate has a non-threaded aperture just below where the output end of the fuel injector rests. The fuel injector is capable of spraying fuel out of the output end through an orifice and on through the non-threaded aperture without impeding a spray pattern of the spraying fuel. The first hand valve is fluidly connected to a cleaning fluid reservoir. The top of the reservoir has a first T connection with a second hand valve and a pressure relief valve extending horizontally therefrom. The first T connection has a second T connection attached at a top input thereof. The second T connection has a pressure gauge extending horizontally therefrom and a third hand valve extending upward therefrom. The third hand valve has a third T connection extending upward therefrom. The third T connection has a quick disconnect fitting extending horizontally therefrom for connecting a hose with pressurized air and has a removable pipe plug extending upward therefrom.

When fuel injector problems suspected in a poorly running vehicle, fuel pump pressure and volume delivery should first be tested. If these are good, then the injectors are suspect. Each cylinder of the engine is typically supplied with fuel from an individual fuel injector. Thus, a eight cylinder engine includes eight fuel injectors.

Fuel injectors contain an electrical coil, a metallic pin which is held against an output orifice within the valve body, and a spring which holds the pin highly against the output orifice to prevent pressurized fuel from escaping out of the output orifice. When the coil is energized with a twelve volt pulse, the metallic pin is pulled away from the output orifice and fuel is forced out of the orifice.

Some fuel injectors have an internal filter which can become clogged, blocking free fuel flow. Such blockage can sometimes be remove with injector cleaning fluids being forced through the injector.

The shape of the output orifice is important because it causes the fuel to spray in a well defined spray pattern to create a uniform mixture of fuel and air in the intake manifold. If the orifice is blocked fully or partially by various contaminants, the spray pattern is negatively effected and will cause poor engine performance in terms of power, acceleration, and fuel economy. Often times, this can be corrected by cleaning the injector valve body output orifice of chemical deposits caused by various fuel components and contaminants.

Suspected individual fuel injectors can be removed from the engine for cleaning and testing. A test stand for testing and cleaning an individual fuel injectors provides for mounting the injector in the stand, providing cleaning fluid at a selected pressure, and energizing the coil once or a given number of times at a selected frequency and pulse width. But before cleaning and testing, it is recommended to test the coil with a digital voltmeter for a shorted or an open coil. Also, check that there is no leakage of fuel when the coil is not energized.

It is an object of this invention to provide a fuel injector cleaning kit which uses pressurized air to force cleaning fluid through the fuel injector nozzle when the injector is opened at a selected frequency by electrical pulses of a selected duration by an included electronic controller.

It is an object of this invention to provide a fuel injector cleaning kit including a test stand with a quick connector for pressurized air, an air gauge and pressure regulator, a cleaning fluid reservoir, a pressure relief valve, various hand valves for pressurizing and depressurizing the input and output ends of the test stand, and an attachment fixture for connecting the fuel injector to be cleaned.

It is an object of this invention to provide a fuel injector cleaning kit which includes an ultrasonic cleaner into which the injector is placed while being cleaned.

It is an object of the present invention to provide a stand and apparatus for testing and cleaning individual fuel injectors.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
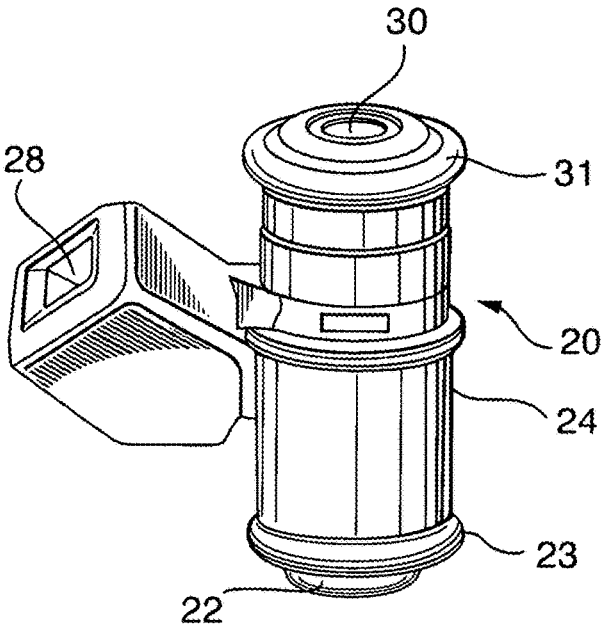
FIG. 1 is a front view of a typical fuel injector.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "about" can be reasonably appreciated by a person skilled in the art to denote somewhat above or somewhat below the stated numerical value, to within a range of +10%.

In accordance with the present invention, there is provided a fuel injector cleaner kit including a fuel injector cleaning stand 10, an electronic fuel injector controller 70 and a stand alone ultrasonic cleaner 100.

Cleaning a fuel injector includes often includes the use of the ultrasonic cleaner. As shown in the FIG. 1-11, the ultrasonic cleaner 100 has a tank or reservoir (not shown) into which is placed the fuel injector with a cleaning fluid. Ultrasonic cleaning is a process that uses ultrasound (usually from 20-400 kHz) and an appropriate cleaning solvent to clean items Cleaning normally lasts between three and six minutes, but can also exceed 20 minutes, depending on the object to be cleaned. Ultrasonic cleaning uses cavitation bubbles induced by high frequency pressure (sound) waves to agitate a liquid. The agitation produces high forces on contaminants adhering to substrates like metals. This action penetrates blind holes, cracks, and recesses. The intention is to thoroughly remove all traces of contamination tightly adhering or embedded onto solid surfaces. Contaminants can include dust, dirt, oil, rust, grease, scale, soot, and so on. Cleaning fluids to be used in an ultrasonic cleaning bath for fuel injectors are commercially available. Such fluids are preferred when using an ultrasonic cleaner to clean fuel injectors. Cleaning fluids may comprise water and a detergent and/or one of the solvent based cleaners described herein as carburetor cleaning solvents.

A fuel injector 20 is basically a solenoid with the needle opening and closing the fuel spray pattern with pulse width modulation. A ball or needle is used to open and close the fuel spray pattern with the needle being the most common arrangement. Spring pressure is used to keep the needle closed when the solenoid is not energized with electric voltage (typically 12 volts). When current is applied, the needle is lifted from the seat, and richer or leaner conditions are determined by pulse or the time the needle is held open. The armature and needle are interrelate and act together.

Figure 2:
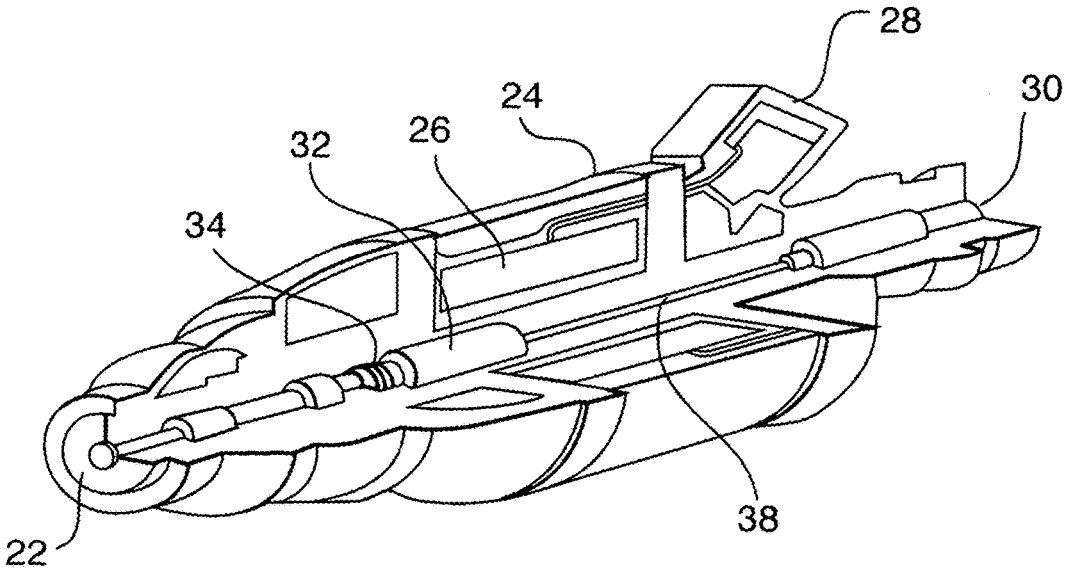
FIG. 2 is a cross-sectional view of a typical fuel injector.

As shown in FIGS. 1 and 2, includes an injector body 24 with an input end 30, an orifice or spray tip 22 at the output end, an electrical connector 28, an internal coil 26, a plunger 32 which opens the valve when the coil 26 is energized, a plunger spring 34 which holds the valve closed normally, and sometimes includes an internal fuel filter. O-rings 31 and 23 seal each end of the fuel injector against fuel leakage.

Figure 3:
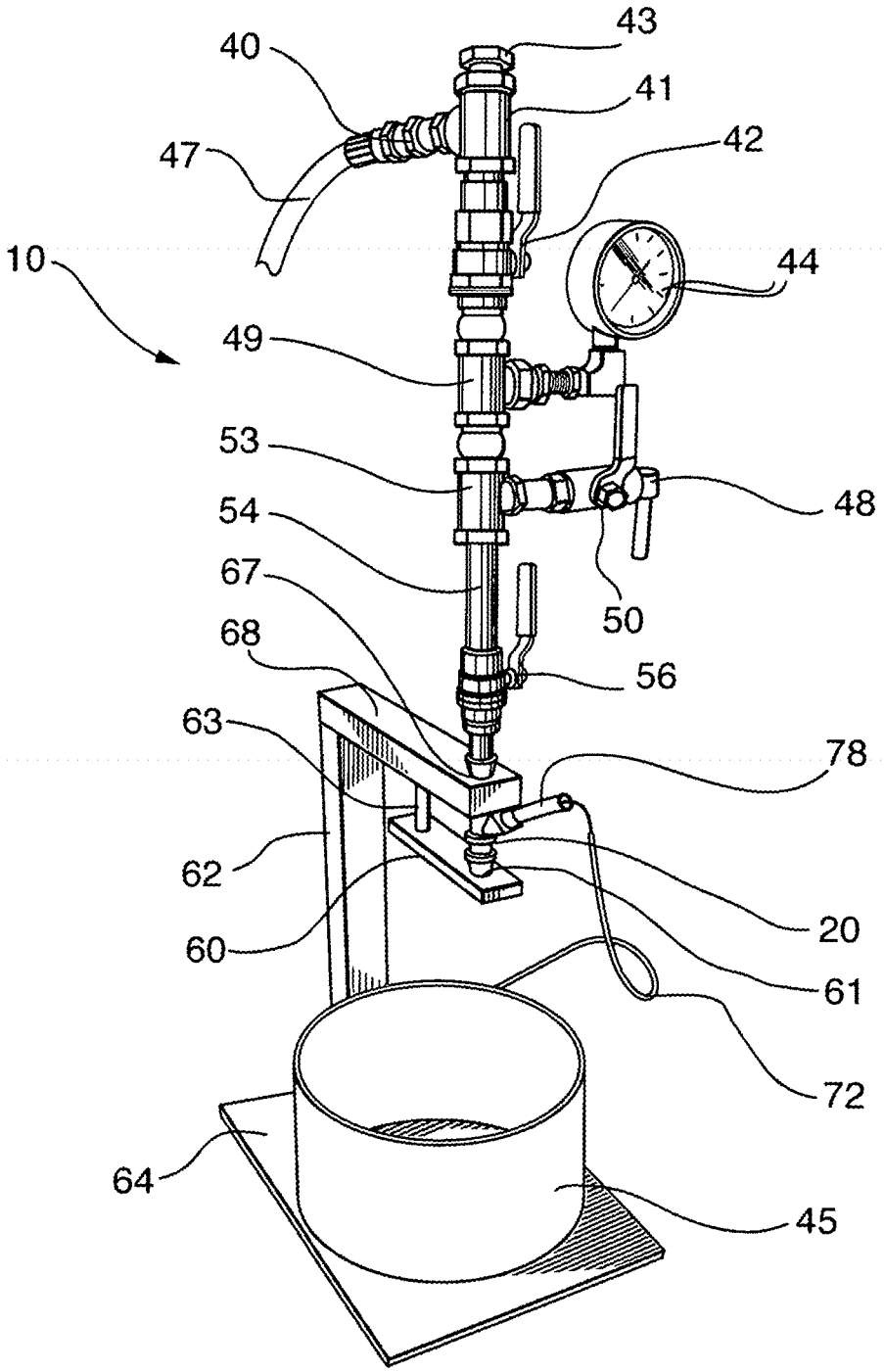
FIG. 3 is a front perspective view of the fuel injector cleaning apparatus.
Figure 13:
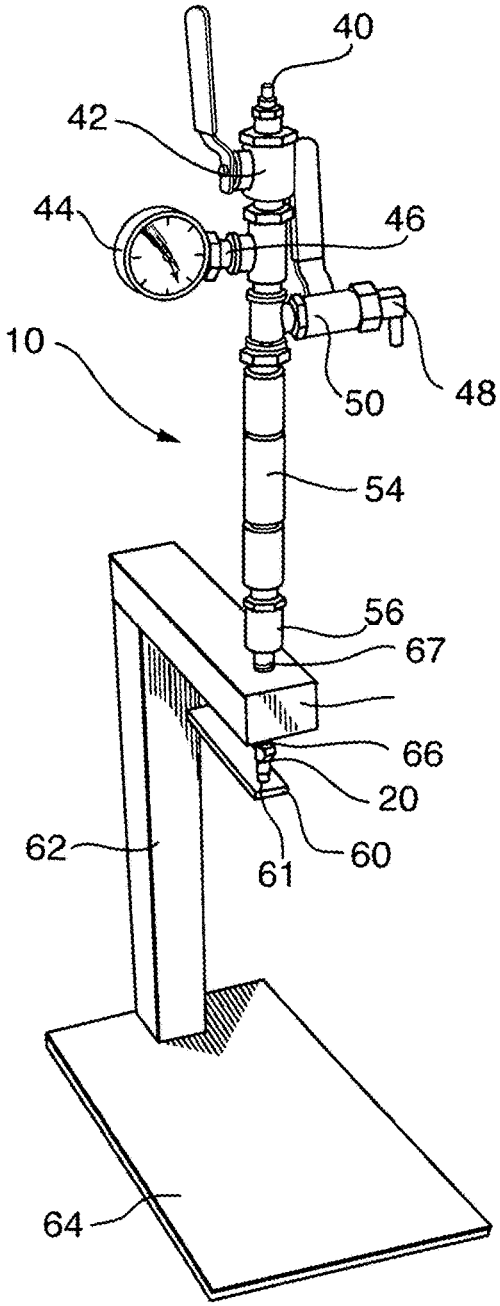
FIG. 13 is a front perspective view of the fuel injector cleaning apparatus.

The fuel injector cleaning stand 10, shown in FIG. 3, includes a horizontal base 64 forming a base with an upward extending post 62. Extending horizontally out from the top end of the post 62 over the base 64 is an arm 68. And hand valve 56 is threaded into the top of an aperture 67 which passes vertically downward through the arm 68. The top half of the aperture 67 is threaded and the bottom half is left smooth to receive the upper O-ring 31.

A retaining plate 60 is rotatably connected to the arm 68 by a rod or bolt 63, such that when the input end 30 of the fuel injector 20 is inserted into the bottom of the aperture 67, the retaining plate 60 is rotated in under the output end 22 of the fuel injector 20 to hold the fuel injector tightly in place. For vertical support of the fuel injector, the retaining plate 60 is then raised against the bottom of the fuel injector 20 with the nozzle end 22 protruding into an aperture 61 in the plate 60 rests. In this position, the fuel injector 20 can spray fuel out of the output end 22 and on through the aperture 61 without impeding the spray in any way. A catch basin 45 rests on the base 64 directly under the fuel injector 20 to catch fuel or cleaning agent which is sprayed out of the fuel injector during the test. The user can then observe the spray pattern for symmetry and uniformity.

Connected to the top of the hand valve 56 is a reservoir 54 which is filled with injector cleaning fluid before each use. Connected to the top of the fluid reservoir 54 is the first T connection 53 with a hand valve 50 with a pressure relief valve 48 extending horizontally from the T. The pressure relief valve 48 is used to release the pressure after the test is done.

A second T 49 is connected to the top connection of the first T. A pressure gauge 44 extends out from the side connection of the second T 49. Attached to the top connection of the second T is a third hand valve 42.

A third T 41 is connected to the top connection of the third hand valve 42. A quick disconnect for supplying pressurized air is connected to the side connection of the third T 41. The incoming air is usually set for a selected pressure between up to 100 psi, and more preferably from 35 to 55 pounds per square inch, but can be set higher, for instance up to 80 psi if desired or required.

Finally, the top connection of the third T is fitted with a plug which is removed to add cleaning fluid to the test stand, that is, to fill the reservoir 54. When the reservoir is full, the plug must be refitted so that the test stand can be pressurized.

Figure 4:
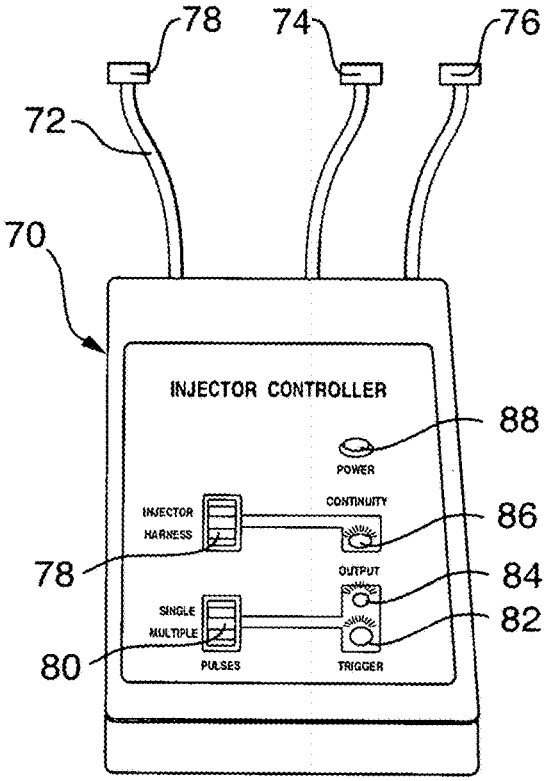
FIG. 4 is a front view of an electronic fuel injector controller.
Figure 5:
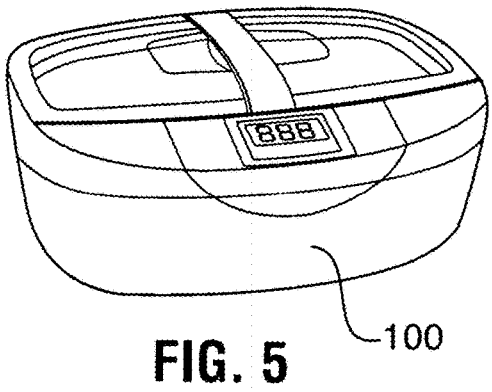
FIG. 5 is a front view of a self contained ultrasonic cleaner.
Figure 6:
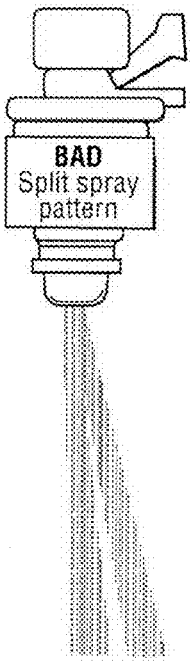
FIG. 6 is a front view of an injector exhibiting a split spray pattern off to one side.
Figure 7:
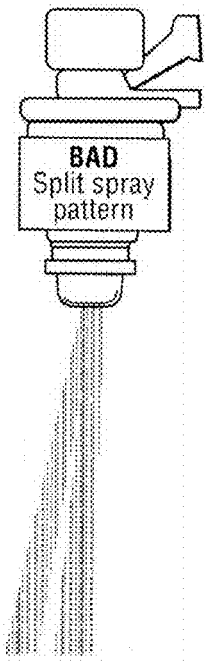
FIG. 7 is a front view of an injector exhibiting a centered split spray pattern.
Figure 8:
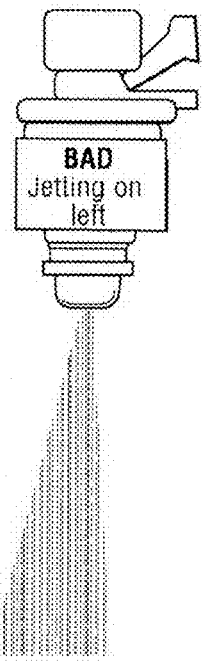
FIG. 8 is a front view of an injector exhibiting a spray pattern jetting to the left side.
Figure 9:
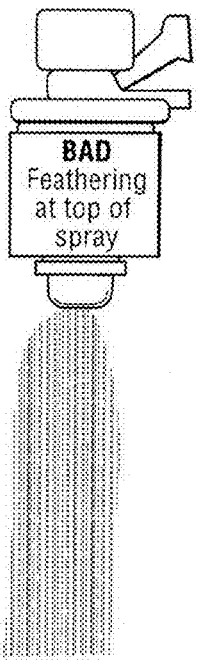
FIG. 9 is a front view of an injector exhibiting a spray pattern feathering at the top.

As shown in FIG. 4, an electronic fuel injector controller 70 includes connectors 76 and 74 for supplying +12 volts and ground, respectively, to the controller. A cable 72 with connector 66 connects to connector 28 on the fuel injector 20 being cleaned and tested. The controller 70 includes a power LED 88, a push button switch 82 for testing the fuel injector coil, an output LED 84 indicating that the injector coil is energized, and a selector switch 80 to select single output pulse mode or multiple output pulses to the injector coil. The controller can be programmed to output either 1 pulse of 500 millisecond duration, 50 pulses of 10 millisecond duration, or 500 pulses of 5 millisecond duration when switch 80 is pressed.

Several types of injector cleaning fluids are available in auto parts stores. One common fuel injector cleaning fluid contains polyetheramine (PEA). A preferred injector cleaning fluid includes the following: distillates, hydro-treated light at 40-70% by weight, Stoddard solvent at 15-40% by weight, naphtha (petroleum), light aromatic at 5-10% by weight, benzene, 1,2,4-trimethyl at 1-5% by weight, and PEA (detergent), polyetheramines at 20-49% by weight. Another cleaning fluid contains polyetheramines in the range of 40-49% by weight. Other injector cleaning fluids contain up to 90% mineral spirits along with other selected distillates and solvents.

One preferred cleaning fluid is mineral oil. Other commercially available cleaning fluids are "choke cleaner" or "carburetor cleaner". Typical carburetor or "injector" cleaning products are described in U.S. Pat. No. 5,955,410 by Dingess et. al., describing an aliphatic ether of a propylene glycol and/or an ester thereof, an alkanolamine, an aliphatic fatty acid blend, an alkyl pyyrolidone, water, and optionally a mild caustic such as ammonium hydroxide; U.S. Pat. No. 3,382,181 by Oberdorfer et al. for a C6 to C13 olefin, a mononucleaer aromatic hydrocarbon and a polar solvent of an ester, glycol ether, or mixtures thereof; U.S. Pat. No. 2,952,637 by Bray et al. for a solvent containing an alkoxy alcohol, aliphatic alcohol, hydrocarbon such as naphtha, a liquid fatty acid such as oleic acid, a volatile nitrogen base such as aqueous ammonia 28% NH3 and water; and U.S. Pat. No. 4,774,015 by Slover for a solvent containing water, sodium meta silicate, trisodium phosphate, tetrasodium salt of ethylene diamine tetra acetic acid, sodium or potassium hydroxide, tall oil fatty acids, a synthetic detergent, and butyl carbitol; all of which are incorporated by reference herein in its entirety.

Figure 10:
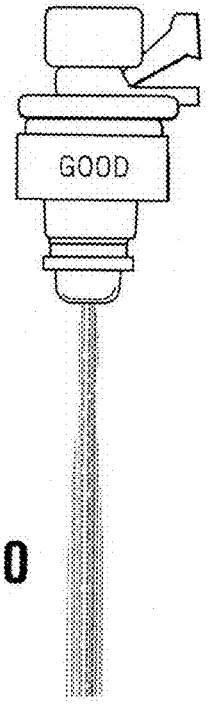
FIG. 10 is a front view of an injector exhibiting a good, centered, symmetrical spray pattern.
Figure 11:
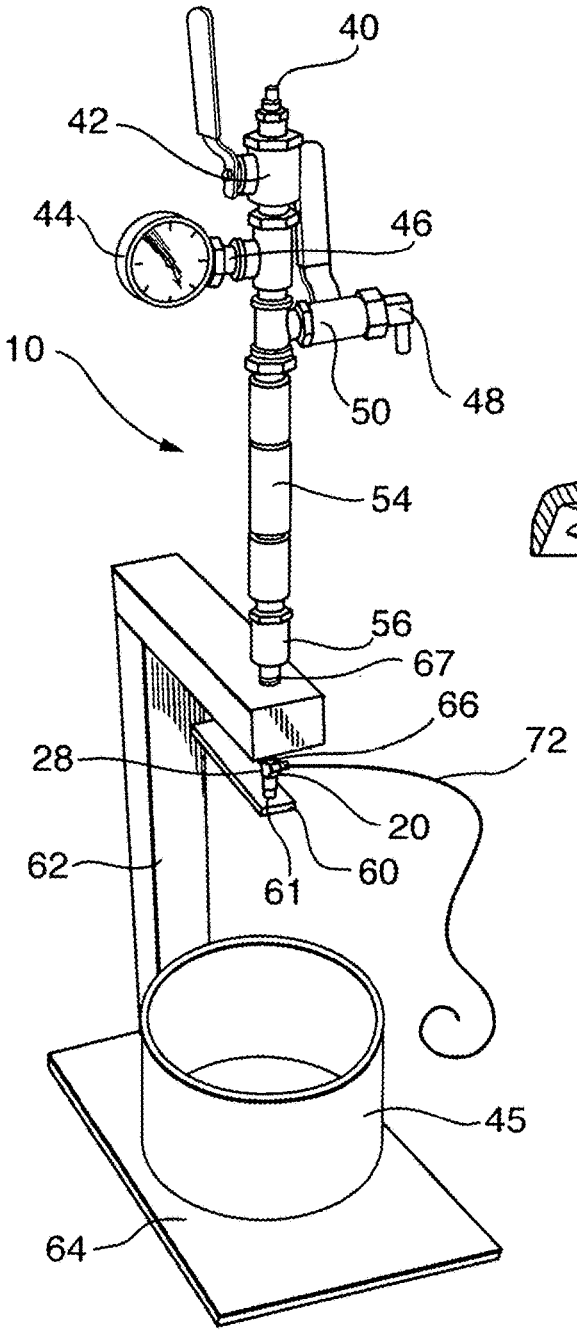
FIG. 11 is a front perspective view of the fuel injector cleaning apparatus including the spent solvent collection reservoir and showing the injector power cord.
Figure 12:
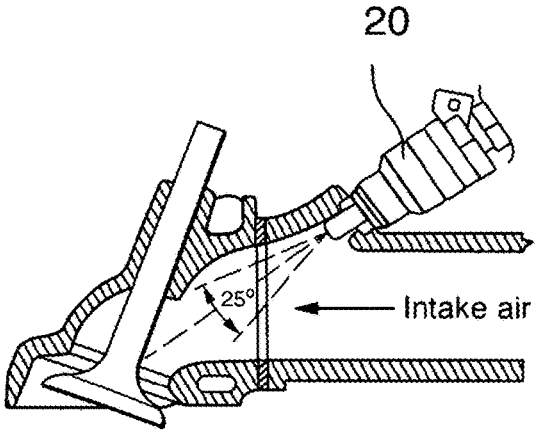
FIG. 12 is a sectional view showing an engine air induction system and fuel injector mounted to the engine.

FIGS. 6-9 are examples of bad spray patterns including split, unsymmetrical, and feathering patterns. FIG. 10 shows an acceptable good spray pattern which is symmetrical with no feathering.

Method of Use

The instant invention is a pneumatic and hydraulic cleaning apparatus using alternating air and liquid pulsed cycles for cleaning and testing used fuel injectors.

The present invention utilizes a CHEVROLET engine injector and fuel system as a typical example of conventional fuel injection systems.

Normal fuel rail pressure is about 39 pounds at idle, and should be checked at no-load and full throttle. The vacuum line should be disconnected on the pressure regulator to fool the system into thinking it is at wide open throttle and normal pressure will be at about 48 pounds. High performance engines will be about 52 pounds. A fuel pressure drop test may be done on the vehicle with the engine off and pulsing injectors on the dead engine to bring obtain the maximum pressure. Never re-use the injector o-rings to prevent leakage in the manifold which causes lean conditions and poor engine performance. A bottle of propane may be used to slowly release the vapor bottle held in an up-right to check for vacuum leaks with the idle air control disconnected. If the revolutions per minute (rpm) increases, a leak is probable.

The most common problems with injectors are carbon build up resulting in restriction of fuel flow, poor fuel delivery and improper fuel spray patterns. Other problems are bent needles, faulty needle, and worn needles. Faulty injector symptoms are hard starting, surging, erratic idle, misfire, stalling, and poor fuel economy.

Before removing the injectors from the fuel rail, a compression test and power balance should be made on the engine, then a fuel pump pressure and volume delivery test made before going to the fuel injection system. The winding in the solenoid should be tested before cleaning and pulse testing to be sure it does not have a shorted or open circuit which can be done with a DVM. Specifications are normally available in advanced repair manuals or on the internet. If data is not available, a new injector can be tested and used as a control. The injector needle must always open the same distance. The pulse width determines fuel delivery. The injector must hold pressure in the static mode without leaking with the engine turned off.

After checking the fuel rail pressure, check the fuel tank pump, use a voltmeter to insure proper voltage.

The fuel injector hydraulic/pneumatic pulse test/cleaning process includes the following steps:

1) Place the fuel injector in the ultrasonic cleaner to run a test or cleaning cycle;
2) Fill the reservoir with a selecting cleaning fluid of mineral oil or carburetor cleaning solution;

3) Install the fuel injector into the cleaning stand (Note the lower o-ring on the injector should be removed to prevent interference with the injector retaining bar and the upper o-ring on the injector lubricated with grease or oil);
4) Connect the injector controller 70 to power and to the fuel inject connector 28;
5) Apply input clean dry air pressure to the air connector 40 at the desired pressure of up to about forty-eight pounds for conventional engines and about fifty-two pounds for high performance engines which is at about full throttles for the engines, a maximum of 100 psi is possible (Never disconnect or connect the air line to the apparatus when the apparatus is pressurized and be sure lines are bleed prior to connection of air line);
6) Set the controller for a selected number of pulses, for instance, 20-50 pulses at switch 80 (the car tester can be used to measure the pressure drop);
7) Push the trigger switch 82 to cause the fuel injector to be pulsed a selected number of times typically 20 to 50 times to flush away carbon;
8) Notice the spray pattern out of the injector while the pulses are occurring to obtain a circular spray pattern and good mist particle size as shown in FIG. 10;
9) Repeat step 7 if the spray pattern is unacceptable as depicted in FIGS. 6-9;
10) If the injector still fails after a few attempts, discard the fuel injector;
11) If the injector passes the spray pattern test, clean and wipe the residue from the tip of the injector, wait about 60 seconds and check the injector tip for moisture—if the tip for the injector is dry the injector is serviceable; and
12) Optionally the fuel injector in the ultrasonic cleaner is used to remove any left over carbon on the injector.

More particularly, the method of cleaning a fuel injector comprises or consists of the steps of:

providing a fuel injector cleaning apparatus and cleaners as described herein comprising or consisting at least an ultrasonic cleaner, a fuel injector cleaning and test stand, and a fuel injector controller. The ultrasonic cleaner includes a container for holding cleaning fluid and a fuel injector and an ultrasonic transducer capable of vibrating the cleaning fluid at a selected ultrasonic frequency and amplitude, and a transducer controller for controlling the transducer. The fuel injector cleaning and test stand includes a horizontal base plate forming a base with an upward extending first longitudinal member forming a post and having a removable waste container for catching cleaning fluid emitted from a fuel injector during testing. The post has a second longitudinal member forming an arm extending horizontally out from a top end thereof over the base plate with the arm having a vertical aperture formed therein and passing through at a free end thereof. The vertical aperture has threads in a top half and has a smooth inner bore in the bottom half so that the smooth inner bore forms a receiver for an input end of a fuel injector with a first hand valve threaded into the threaded top half of the vertical aperture. A bottom of the vertical aperture capable receives and an input end of a fuel injector to be cleaned along with a sealing O-ring. The arm has a retaining plate rotatably connected to a bottom surface thereof such that when the input end of the fuel injector is inserted into the receiver the retaining plate is rotated in under an output end of the fuel injector to hold the fuel injector tightly in place. The retaining plate has an non-threaded aperture just below where the output end of the fuel injector rests. The fuel injector is capable of spraying fuel out of the output end through an orifice and on through the non-threaded aperture without impeding a spray pattern of the spraying fuel. The first hand valve fluidly connects to a cleaning fluid reservoir and a top of the reservoir has a first T connection with a second hand valve and a pressure relief valve extending horizontally therefrom. The first T connection has a second T connection attached at a top input thereof and a pressure gauge extends horizontally therefrom and a third hand valve extending upward therefrom. The third hand valve has a third T connection extending upward therefrom with a quick disconnect fitting extending horizontally therefrom and having a removable pipe plug extending upward therefrom. The cleaning fluid containing various distillates and solvents. The fuel injector controller is capable of being connected to a power source and to electrical contacts of a fuel injector, and supplying twelve volt pulses at a selected frequency and pulse width to energize a coil of the fuel injector to be tested and cleaned, thus causing the fuel injector to spray the cleaning fluid under pressure out of the orifice at the output end. The steps of cleaning an injector comprises or consists of placing a fuel injector in the ultrasonic cleaner and run a cleaning cycle; removing the removable pipe plug; filling the reservoir with the cleaning fluid; re-installing the removable pipe plug to seal the reservoir; installing a fuel injector into the receiver; connecting the injector controller to the power source and to the fuel injector connector; applying input air pressure to the quick disconnect; selecting a desired pressure at the pressure regulator; setting the fuel injector controller for multiple pulses; pushing a trigger switch on the controller to cause the fuel injector to be pulsed a selected number of times; taking notice of a spray pattern emitting from the fuel injector while the pulses are occurring; repeating preceding two steps one time if the spray pattern is unacceptable; discarding the fuel injector if the injector still fails; and removing and saving the fuel injector when the spray pattern is acceptable.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above.

I claim:

1. A pneumatic and hydraulic fuel injector cleaning apparatus, comprising:

an ultrasonic cleaner, a fuel injector cleaning and test stand, and a fuel injector controller, said ultrasonic cleaner including a container for holding cleaning fluid and a fuel injector, an ultrasonic transducer capable of vibrating said container and said cleaning fluid at a selected ultrasonic frequency and amplitude, and a controller for controlling said transducer;

said fuel injector cleaning and test stand including a horizontal base plate forming a base with an upward extending first longitudinal member forming a post, said base plate supporting a removable waste container for catching cleaning fluid emitted from a fuel injector during testing, said post having a second longitudinal member forming an arm extending horizontally out from a top end thereof over said base plate, said arm having a vertical aperture formed therein and passing through at a free end thereof, said vertical aperture having threads in a top half and having a smooth inner bore in the bottom half said smooth inner bore forming a receiver for an input end of a fuel injector, with a first hand valve threaded into said threaded top half of said vertical aperture, a bottom of said vertical aperture capable of receiving an input end of a fuel injector to be cleaned along with a sealing O-ring, said arm having a retaining plate rotatably connected to a bottom surface thereof such that when said input end of said fuel injector is inserted into said receiver, said retaining plate is rotated in under an output end of said fuel injector to hold said fuel injector tightly in place, said retaining plate having an non-threaded aperture just below where said output end of said fuel injector rests, said fuel injector capable of spraying fuel out of said output end through an orifice and on through said non-threaded aperture without impeding a spray pattern of said spraying fuel, said first hand valve fluidly connected to a cleaning fluid reservoir, a top of said reservoir having a first T connection with a second hand valve and a pressure relief valve extending horizontally therefrom, said first T connection having a second T connection attached at a top input thereof, said second T connection having a pressure gauge extending horizontally therefrom and a third hand valve extending upward therefrom, said third hand valve having a third T connection extending upward therefrom, said third T connection having a quick disconnect fitting extending horizontally therefrom and having a removable pipe plug extending upward therefrom;

said cleaning fluid containing various distillates and solvents; and said fuel injector controller capable of being connected to a power source and to electrical contacts of a fuel injector, and supplying twelve volt pulses at a selected frequency and pulse width to energize a coil of said fuel injector to be tested and cleaned, thus causing said fuel injector to spray said cleaning fluid out of said orifice at said output end.

2. The fuel injector pneumtic and hydraulic cleaning apparatus claimed in claim 1 including polyetheramines at 40-49% by weight.

3. A method of cleaning a fuel injector with a pneumatic and hydraulic apparatus comprising the steps of:

providing a fuel injector cleaning kit, said kit comprising:

an ultrasonic cleaner, a fuel injector cleaning and test stand, and a fuel injector controller;

said ultrasonic cleaner including a container for holding cleaning fluid and a fuel injector, an ultrasonic transducer capable of vibrating said container and said cleaning fluid at a selected ultrasonic frequency and amplitude, and a transducer controller for controlling said transducer;

said fuel injector cleaning and test stand including a horizontal base plate forming a base with an upward extending first longitudinal member forming a post, said base plate supporting a removable waste container for catching cleaning fluid emitted from a fuel injector during testing, said post having a second longitudinal member forming an arm extending horizontally out from a top end thereof over said base plate, said arm having a vertical aperture formed therein and passing through at a free end thereof, said vertical aperture having threads in a top half and having a smooth inner bore in the bottom half said smooth inner bore forming a receiver for an input end of a fuel injector, with a first hand valve threaded into said threaded top half of said vertical aperture, a bottom of said vertical aperture capable of receiving and an input end of a fuel injector to be cleaned along with a sealing O-ring, said arm having a retaining plate rotatably connected to a bottom surface thereof such that when said input end of said fuel injector is inserted into said receiver, said retaining plate is rotated in under an output end of said fuel injector to hold said fuel injector tightly in place, said retaining plate having an non-threaded aperture just below where said output end of said fuel injector rests, said fuel injector capable of spraying fuel out of said output end through an orifice and on through said non-threaded aperture without impeding a spray pattern of said spraying fuel, said first hand valve fluidly connected to a cleaning fluid reservoir, a top of said reservoir having a first T connection with a second hand valve and a pressure relief valve extending horizontally therefrom, said first T connection having a second T connection attached at a top input thereof, said second T connection having a pressure gauge extending horizontally therefrom and a third hand valve extending upward therefrom, said third hand valve having a third T connection extending upward therefrom, said third T connection having a quick disconnect fitting extending horizontally therefrom and having a removable pipe plug extending upward therefrom;

said cleaning fluid containing various distillates and solvents; and said fuel injector controller capable of being connected to a power source and to electrical contacts of a fuel injector, and supplying twelve volt pulses at a selected frequency and pulse width to energize a coil of said fuel injector to be tested and cleaned, thus causing said fuel injector to spray said cleaning fluid under pressure out of said orifice at said output end;

placing a fuel injector in said ultrasonic cleaner and run a cleaning cycle;

removing said removable pipe plug;

filling said reservoir with said cleaning fluid;

re-installing said removable pipe plug to seal said reservoir;

installing a fuel injector into said receiver;

connecting said injector controller to said power source and to said fuel injector connector;

applying input air pressure to said quick disconnect;

selecting a desired pressure at said pressure regulator;

setting said fuel injector controller for multiple pulses;

pushing a trigger switch on said controller to cause said fuel injector to be pulsed a selected number of times;

taking notice of a spray pattern emitting from said fuel injector while said pulses are occurring;

repeating preceding two steps one time if said spray pattern is unacceptable;

discarding said fuel injector if said injector still fails; and removing and saving said fuel injector when said spray pattern is acceptable.

* * * * *